US008226441B2

(12) United States Patent
Regnier et al.

(10) Patent No.: US 8,226,441 B2
(45) Date of Patent: Jul. 24, 2012

(54) CONNECTOR WITH IMPROVED MANUFACTURABILITY

(75) Inventors: Kent E. Regnier, Lombard, IL (US); Patrick R. Casher, North Aurora, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/063,008

(22) PCT Filed: Sep. 9, 2009

(86) PCT No.: PCT/US2009/056318

§ 371 (c)(1),
(2), (4) Date: May 9, 2011

(87) PCT Pub. No.: WO2010/030635

PCT Pub. Date: Mar. 18, 2010

(65) Prior Publication Data

US 2011/0223810 A1 Sep. 15, 2011

Related U.S. Application Data

(60) Provisional application No. 61/095,450, filed on Sep. 9, 2008, provisional application No. 61/110,748, filed on Nov. 3, 2008, provisional application No. 61/117,470, filed on Nov. 24, 2008, provisional application No. 61/153,579, filed on Feb. 18, 2009, provisional application No. 61/170,956, filed on Apr. 20, 2009, provisional application No. 61/171,066, filed on Apr. 20, 2009, provisional application No. 61/171,037, filed on Apr. 20, 2009.

(51) Int. Cl.
*H01R 24/00* (2011.01)

(52) U.S. Cl. ..... 439/626

(58) Field of Classification Search ..... 439/626, 439/607.05, 607.07, 49, 510–512, 701, 736, 439/65, 108, 101, 79, 607.02, 607.11
See application file for complete search history.

(56) References Cited

U.S. PATENT DOCUMENTS

| | | | | |
|---|---|---|---|---|
| 6,293,827 | B1 | 9/2001 | Stokoe | |
| 6,843,687 | B2 * | 1/2005 | McGowan et al. | 439/607.06 |
| 6,890,214 | B2 * | 5/2005 | Brown et al. | 439/607.39 |
| 7,121,889 | B1 * | 10/2006 | Jeon | 439/607.1 |
| 7,175,446 | B2 | 2/2007 | Bright et al. | |
| 7,347,740 | B2 | 3/2008 | Minich | |
| 7,410,393 | B1 | 8/2008 | Rothermel | |
| 7,651,337 | B2 * | 1/2010 | McNamara | 439/65 |
| 7,883,367 | B1 * | 2/2011 | Kline | 439/607.05 |
| 2007/0021002 | A1 * | 1/2007 | Laurx et al. | 439/608 |

OTHER PUBLICATIONS

International Search Report for PCT/US2009/056318.

* cited by examiner

*Primary Examiner* — Edwin A. Leon
(74) *Attorney, Agent, or Firm* — Stephen L. Sheldon

(57) ABSTRACT

An I/O connector has a housing that contains a plurality of individual terminal wafers containing terminal dedicated to either ground signals or differential signals. The terminals are arranged in widthwise order to define broadside coupled differential signal terminal pairs. The ground terminals are wider than the signal terminals to provide shielding to the differential signal pairs. The body portions of the ground terminals include pairs of opposed notches that provide for increased retention of the ground terminals in the wafer and provide increased flow for molding material during the formation of the wafers.

19 Claims, 10 Drawing Sheets

CONNECTOR WITH IMPROVED MANUFACTURABILITY

REFERENCE TO RELATED APPLICATIONS

This application is a national phase of international application PCT/US09/56318, filed Sep. 9, 2009 and claims priority to U.S. Provisional Appln. No. 61/095,450, filed Sep. 9, 2008; to Appln. No. 61/110,748, filed Nov. 3, 2008; to Appln. No. 61/117,470, filed Nov. 24, 2008; to Appln. No. 61/153,579, filed Feb. 18, 2009, to Appln. No. 61/170,956 filed Apr. 20, 2009, to Appln. No. 61/171,037, filed Apr. 20, 2009 and to Appln. No. 61/171,066, filed Apr. 20, 2009, all of which are incorporated herein by reference in their entirety.

BACKGROUND OF THE INVENTION

The present invention generally relates to connectors suitable for transmitting data, more specifically to a compact connector with improved impedance characteristics.

There is an ongoing effort in the telecommunications field to increase performance, while reducing the size of connectors used in the field. For input/output ("I/O") connectors used in data communication, these efforts create somewhat of a problem. Using higher frequencies (for increased data rates) requires reliable electrical separation between signal terminals in a connector that minimizes cross-talk. However, reducing the size of the connector and making the terminal arrangement more dense, brings the terminals closer together, which typically results in a decrease in electrical separation.

There is also a desire to improve manufacturing. For example, as signaling frequencies increase, the tolerance of locations of terminals, as well as their physical characteristics become more important in that they influence the operation of the connector. Therefore, improvements to a connector design that would facilitate manufacturing while still providing a dense, high-performance connector are desired. Many I/O connector utilize small signal and ground terminals held in terminal assemblies that include insulative frames, such as wafers. In order to improve electrical separation with differential signal terminal pairs in small-size connectors, care must be taken to isolate such pairs with ground terminals. It is difficult to inexpensively hold larger ground terminals in place during manufacturing of the terminals and ensure complete formation of the insert frames, or wafers. Therefore, certain individuals would appreciate an improved connector that provided allows for improved manufacturing.

SUMMARY OF THE INVENTION

A connector includes a hollow housing that includes a plurality of wafers held together as a unit by a hollow housing. Each wafer supports multiple terminals and contains terminals that are either used as ground terminals or as signal terminals. The terminals have contact portions at one end and tail portion at an opposing end, and body portions that interconnect the contact and tail portions together. The ground terminals may be configured in dimensions so that it is wider than adjacent signal terminals. In order to hold the wider ground terminals in place within the wafers, and to improve manufacturability of the connector, the ground terminals are notched in their body portions, particularly those portions that extend at an angle within the wafers. These notches extend inwardly, preferably in pairs, from opposing edges of the ground terminal body portions and are offset from each other with respect to adjacent ground terminals and the notches provide increased areas of flow for the molding material from which the wafers are made to pass.

BRIEF DESCRIPTION OF THE DRAWINGS

Throughout the course of the following detailed description, reference will be made to the drawings in which like reference numbers identify like parts and in which.

DETAILED DESCRIPTION

As required, detailed embodiments of the disclosure are disclosed herein; however, it is to be understood that the disclosed embodiments are merely exemplary and may be embodied in various forms. Therefore, specific details disclosed herein are not to be interpreted as limiting, but merely as a basis for the claims and as a representative basis for teaching one skilled in the art to variously employ the disclosure in virtually any appropriate manner, including employing various features disclosed herein in combinations that might not be explicitly disclosed herein.

Figure 1:
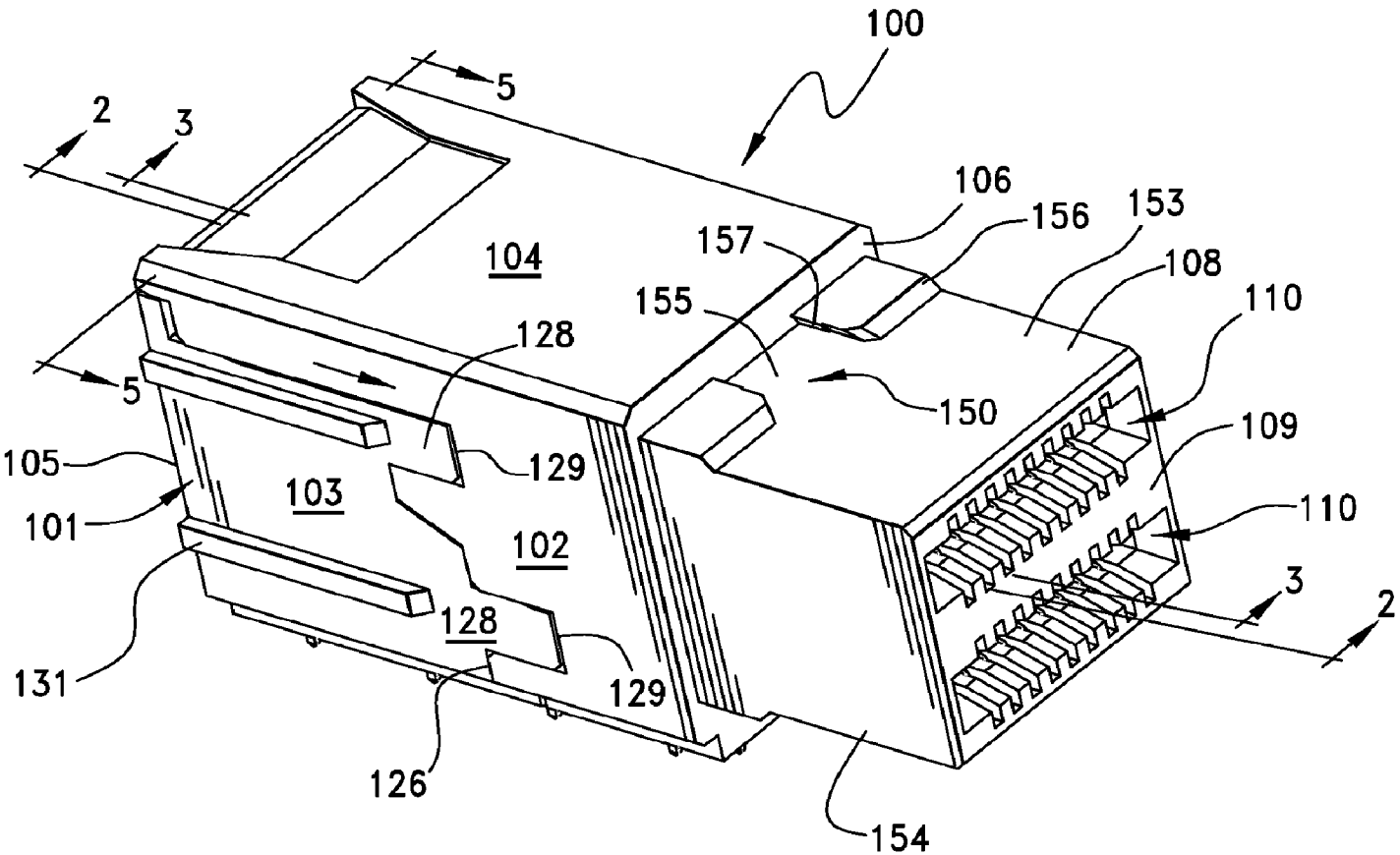
FIG. 1 is a perspective view of a connector constructed in accordance with the principles of the present invention.

FIG. 1 illustrates a connector 100. The connector 100 has a housing 101 which is illustrated as having two interengaging first and second (or front and rear) pieces, or parts, 102, 103. The housing 101, as shown in FIG. 1 has a wide body portion 104 that extends between a rear face 105 and the front face 106. A mating portion 107 that takes the form of an elongated nose portion 108 projects forwardly of the front face 106 and terminates in a front mating face 109. The mating face 109 may have one or more circuit card-receiving slots 110 which are formed widthwise in the mating face 109, with two such slots 110 being shown in FIG. 1.

Figure 2:
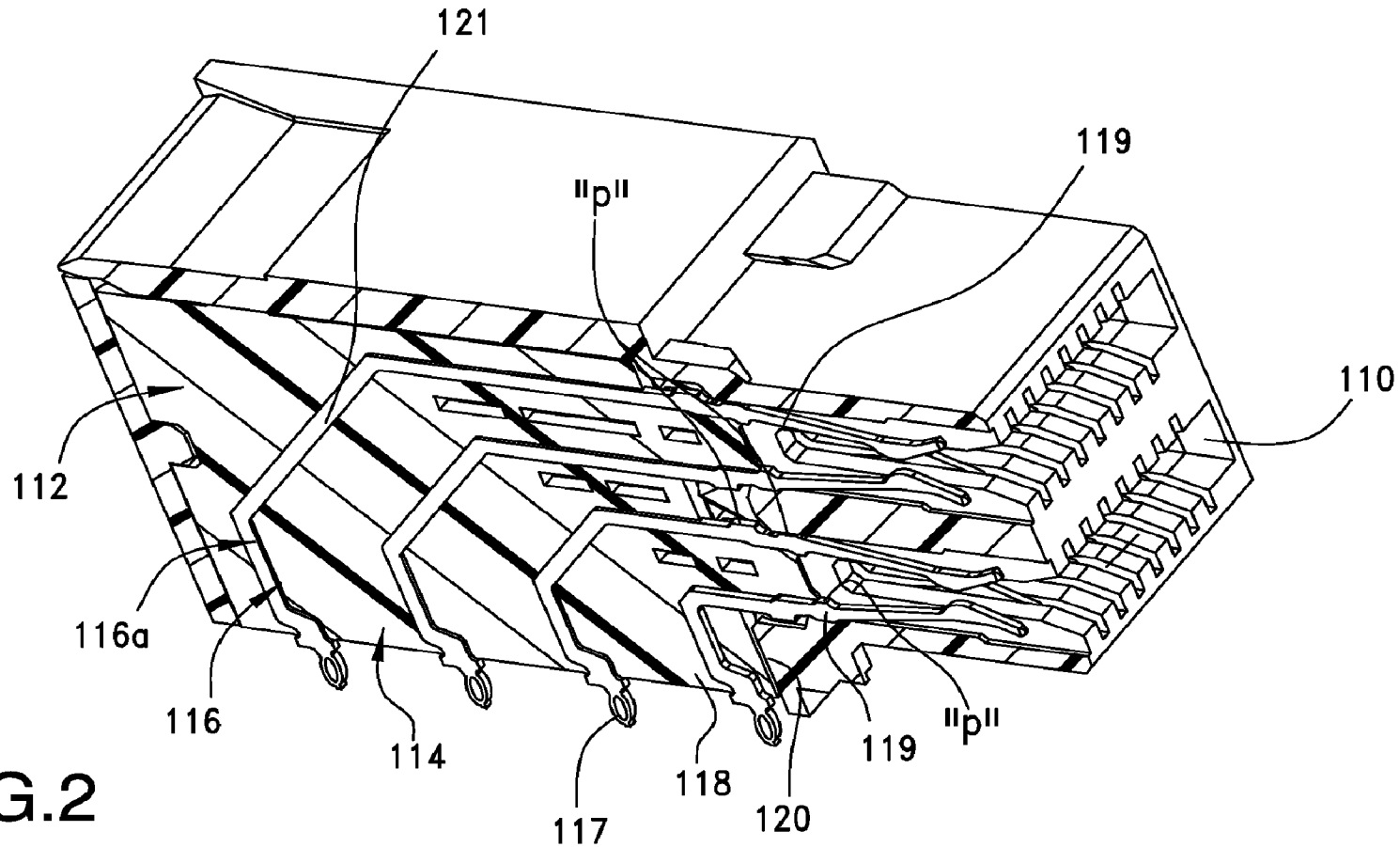
FIG. 2 is a sectional view of the connector of FIG. 1, taken along lines 2-2 thereof.
Figure 3:
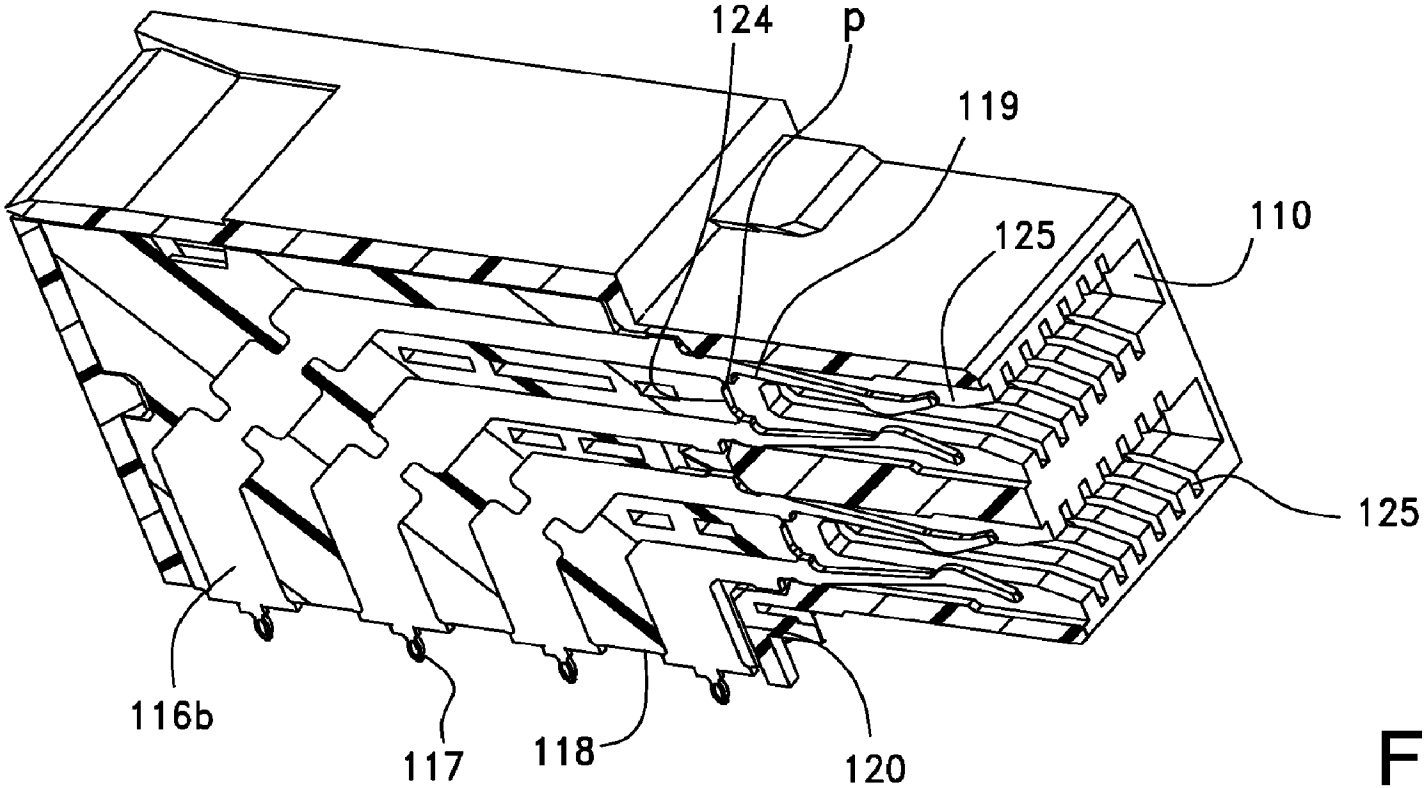
FIG. 3 is a sectional view of the connector of FIG. 1, taken along lines 3-3 thereof.
Figure 4:
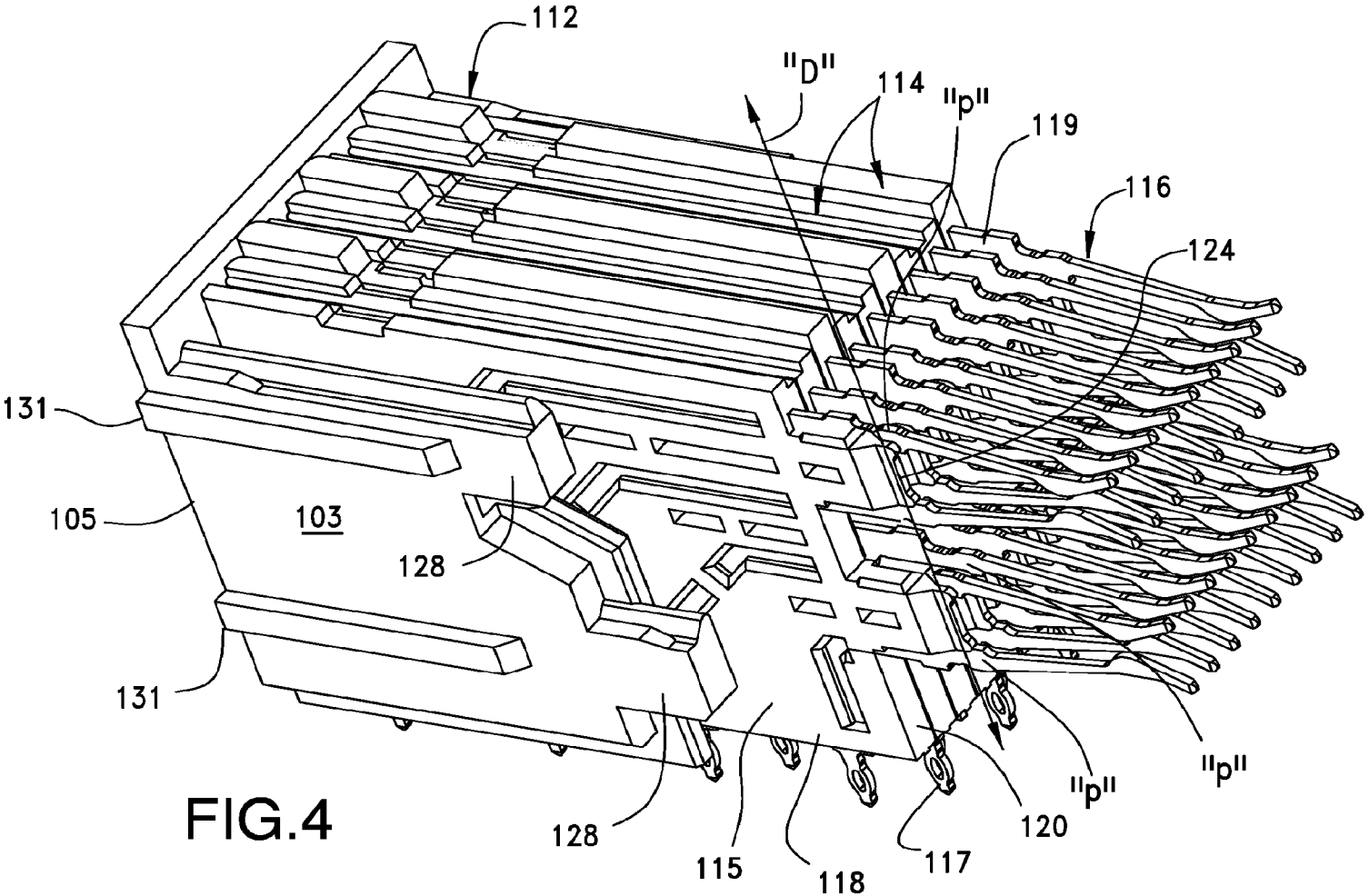
FIG. 4 is a perspective view of the connector of FIG. 1, with the housing front portion removed to show the internal terminal assemblies.

As shown in FIGS. 2-3, the housing 101 has a hollow interior portion 112 that receives a plurality of individual terminal assemblies 114 that take the form of wafers 115. Each such wafer 115 contains a plurality of conductive terminals 116 supported by an insulated material and each such terminal includes tail portions 117 projecting out from a first edge 118 and contact portions 119 projecting from a second edge 120 of the wafer 115. As illustrated, the two edges 118, 120 are adjacent each other. The first edge 118 of the terminal assemblies 114 serves as a mounting edge, or face, for the block of terminal assemblies shown in FIG. 4. The second edge 120 which is offset from the first edge 118, serves as a mating edge, or face, for the terminal assemblies 120. The terminals 116 further include body portions 121 that interconnect the tail and contact portions 117, 119 together. The terminal assembly wafers 115 may have openings 123 formed therein in the form of slots that extend along the terminal body portions 121 to expose them to air and thereby affect the terminal impedance.

The wafers 115 are held together as a block within the housing 101 in a manner such that the terminal tail portions 117 extend out through the bottom of the housing 101 and the terminal contact portions 119 extend from the edges 120 of their wafers 115 into the housing nose portion 108. The terminal contact portions 119 are arranged in the wafers 115 as pairs of terminals and these pairs are located on the upper and lower sides of the card-receiving slots 110. (FIGS. 2 and 3.) As explained in greater detail below, the terminals 116 of the connector are arranged in distinct sets, within respective wafers, of ground terminals 116*b* and signal terminals 116*a*, with one wafer containing only ground terminals 116*b* and two wafers containing only signal terminals 116*a*. The two signal terminal-carrying wafers are arranged such that they define pairs of signal terminals 116*a* which are broadside coupled, so as to transmit differential signals through the connector.

Figure 6:
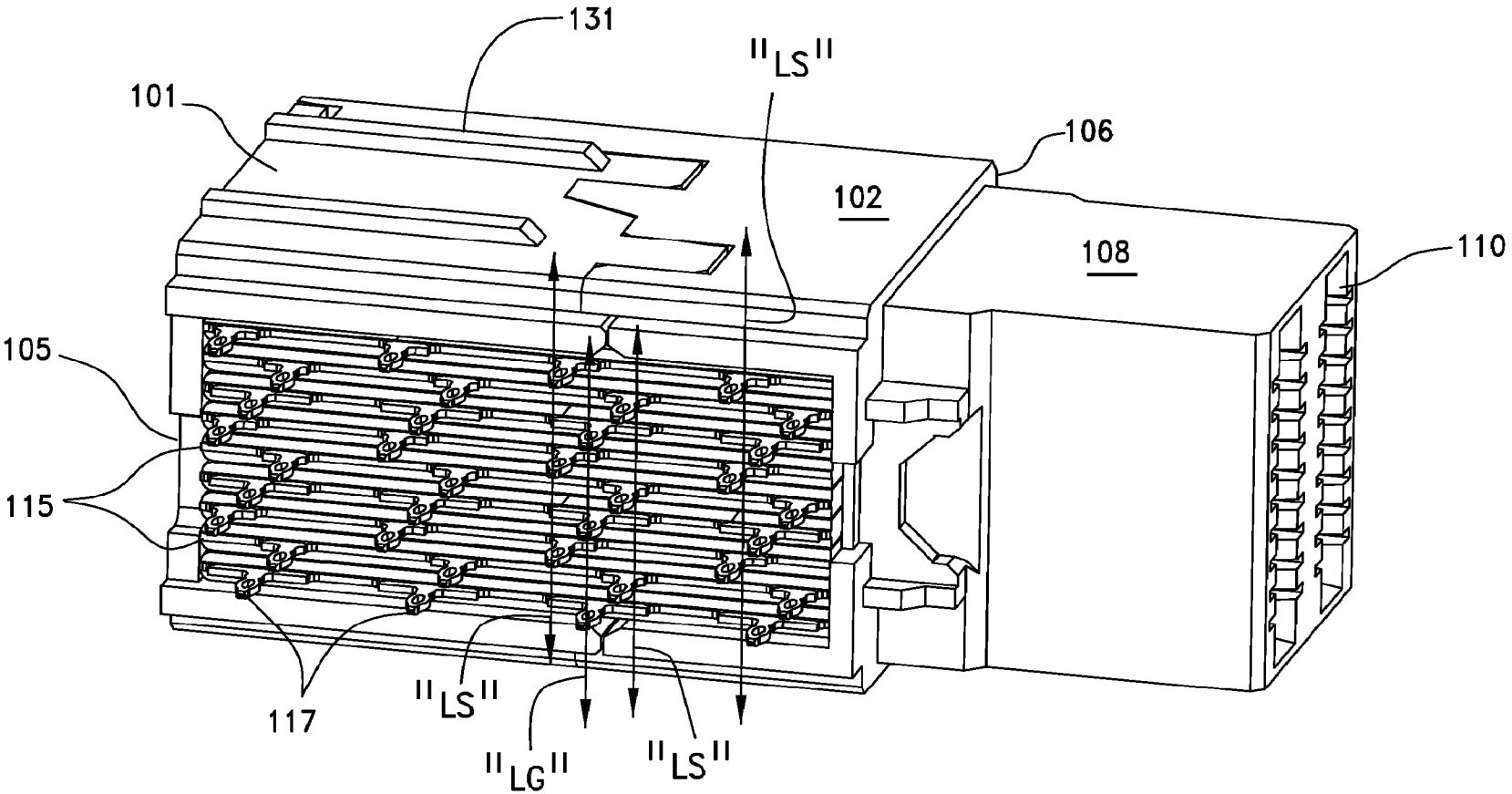
FIG. 6, is a perspective view of the connector of FIG. 1 shown on its side.

The terminals 116 are further provided as sets of thin signal terminals 116*a* as shown in FIG. 2, and wide ground terminals 116*b*, as shown in FIG. 3. The terminals 116, as noted above, project forwardly from the second edge 120 of the wafers 115 and selected portions 124 of the wafers 115 extend past the second edge 120. The selected portions 124 are provided to hold the terminal contact portions 119 in place within the forward nose portion and to move the point "P" around which the terminal contact portions deflect into the nose portion 108 of the housing 101, as shown in FIG. 3. As shown in FIG. 6, the terminal tail portions 117 of each distinct set of wafers 115 are aligned laterally (widthwise) of the connector 100. That is, all of the ground terminal tail portions 117*b* are arranged on respective widthwise lines such as "LG" in FIG. 6. Likewise, the signal terminal tail portions 117*a* are also arranged along their own respective coincident lines "LS"

As can be understood from the drawings, the contact portions 119 are cantilevered in their structure and act as contact beams that deflect away from the slots 110 when a circuit card is inserted therein. In order to accommodate this upward and downward deflection of the contact portions 119, the nose portion 108 of the housing 101 has terminal-receiving cavities 125 that extend from a vertical preselected above and below centerlines of each slot 110. Preferably, as will be explained more below, the ends of the selected portions 124 run along a line "D" that is close to, or most preferably, substantially coincident with the deflection points "P". (FIG. 2.) The connector 100 may be enclosed in a shielded, exterior housing, not shown, and as such, the height of the connector is restricted, not only to a height that will fit inside of an exterior housing, but also a height that accommodates the two edge cards of an opposing, mating connector.

Returning to FIGS. 1-4, the housing 101 has its two pieces 102, 103 mate along an irregular mating line 126 that extends upwardly through the sides of the housing 101 along a path that extends from front to rear of the housing 101. This irregular mating line facilitates the molding of the housings and it is explained in greater detail in U.S. Provisional Patent Application No. 61/122,102, filed Dec. 12, 2008 for "Two-Piece Thin Wall Housing." The two housing parts 102, 103 interlock together or engage with each other along this irregular and non-linear mating line 126. With this irregular configuration, a pair of rails 128, and channels 129 are defined in the two housing pieces 102, 103 with the rails 128 fitting into the channels 129. Outer ribs 131 may also be formed on the exterior side surfaces of the rear housing part 103 and these ribs 131 are preferably horizontally aligned with the rails 128 to provide reinforcement to the rails 128, but also to provide a means for positioning the connector subassembly 100 within an exterior housing or shroud.

Figure 5:
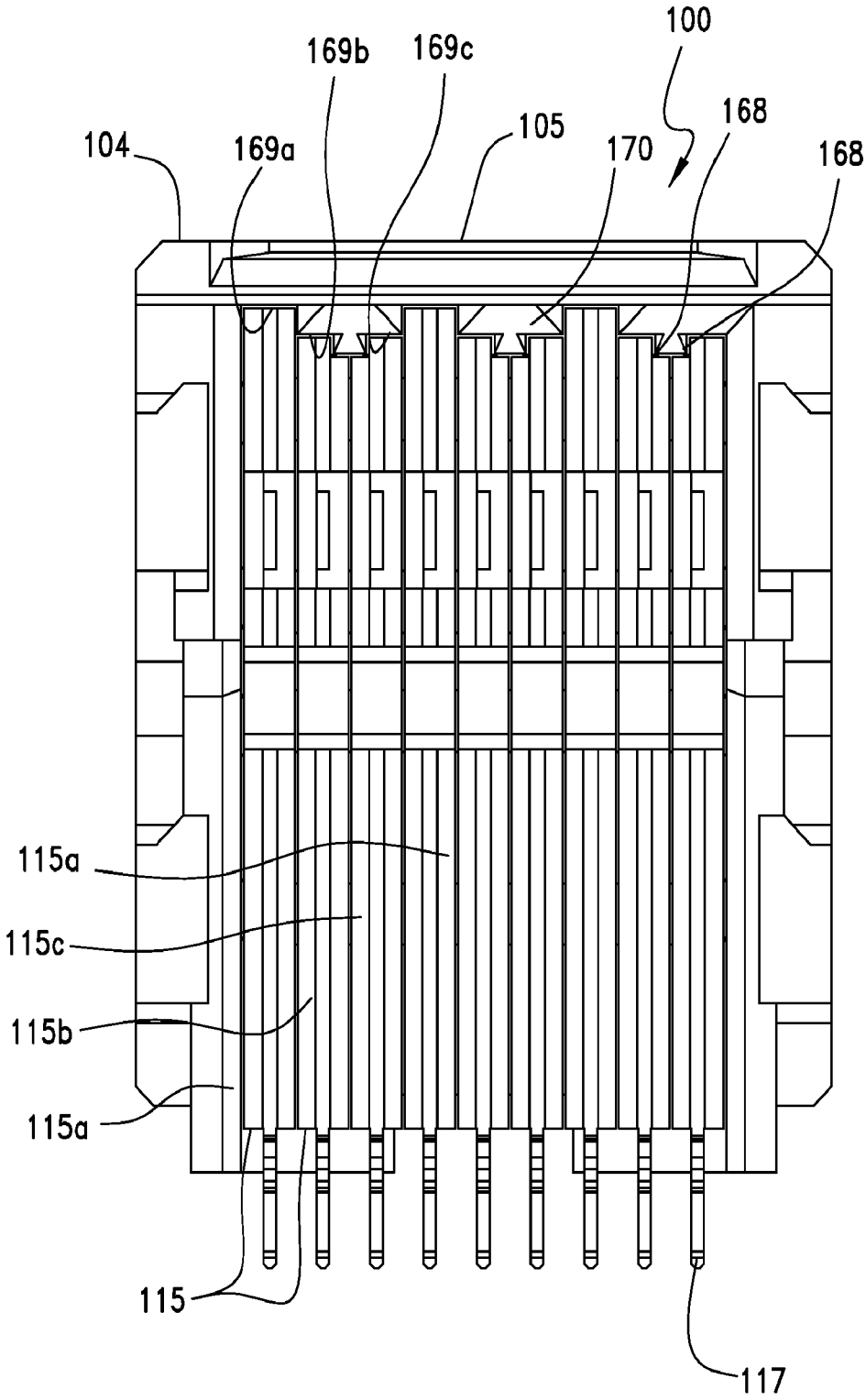
FIG. 5 is a rear elevational view of the connector of FIG. 1, taken along lines 5-5 thereof.

FIG. 5 is a rear elevational view of the connector 100. The hollow interior is configured to provide different slots for the different wafers. While not required, this helps eliminate the incorrect assembly of the connector and also permits the different types of wafers to be located and inserted as groups of ground terminal wafers, left signal terminal wafers and right signal terminal wafers. These wafers may also be respectively referred to as first, second and third wafers. As noted above, the signal terminals face each other and are broadside coupled. In order to accomplish such coupling, three different types of wafers are utilized in the connector 100.

As shown in FIG. 5, the wafer at the leftmost edge of the interior of the housing 101 is a first wafer 115*a*, and next to it is a second wafer 115*b*. This wafer 115*b* is referred to as a "left" terminal wafer in that its terminals will make up the left side of the differential signal terminal pairs. Next in line is inserted a third wafer 115*c*, which can be referred to as a right terminal wafer as the terminals make up the right sides of the differential signal terminal pairs. Lastly, this pattern of three repeats itself again, starting with the first wafer 115*a*. In this manner, the connector will house a plurality of differential signal terminal pairs in the widthwise direction. In the embodiment illustrated, the broadside coupled differential signal terminal pairs are arranged in four rows of terminals, 140*a*, 140*b*, 140*c* and 140*d*. The differential signal terminal pairs in rows 140*a* and 140*c* engage contacts disposed on the upper surfaces of two edge, or paddle, cards of an opposing, mating connector (not shown), while the differential signal terminal pairs in rows 140*b* and 140*d* engage contacts disposed on the lower surfaces of the two edges cards.

Each of these three types of wafers are polarized, or keyed by virtue of their individual configurations. The ground terminal assembly wafers 115*a* are taller than either of the two signal terminal wafers 115*b*, 115*c* and hence can only be inserted into the slots 169*a* disposed in the front half, 102 of the housing 101, that are designated for ground terminal assembly wafers Likewise, the left signal terminal assembly wafer 115*b* is specially configured with a step, or recess 168*b*, as illustrated to fit only in a slot which is designated to receive it, namely slot 169*b*, as is the right signal terminal assembly wafer 115*c* is only received in slots 169*c* because it has a step, or recess 168*c* that faces the step 168*b* of the adjacent signal wafer 115*b*.

Theses steps 168*b, c* that are formed in the signal terminal assembly wafers 115*b*, 115*c* engage dovetailed members 170 of the housing 101 that project into the hollow interior 112 of the housing 101. Other means of polarizing, or keying, the wafers 115 may be utilized, such as varying the height of the wafers 115 and the slots 169. In this manner, each distinct set of terminal assembly wafers may be loaded into the housing 101 as a group to facilitate assembly. One aspect that can be appreciated is that the three-wafer system can be stitched into the housing interior 112 without first combining two or more of the wafers 115 together. This has the benefit of providing a convenient manufacturing process. Importantly, due to the difference of heights and or steps, the proper wafers can only be inserted into their respective proper housing slots, lending the housing capable of being assembled by low-cost, unskilled labor.

Figure 7:
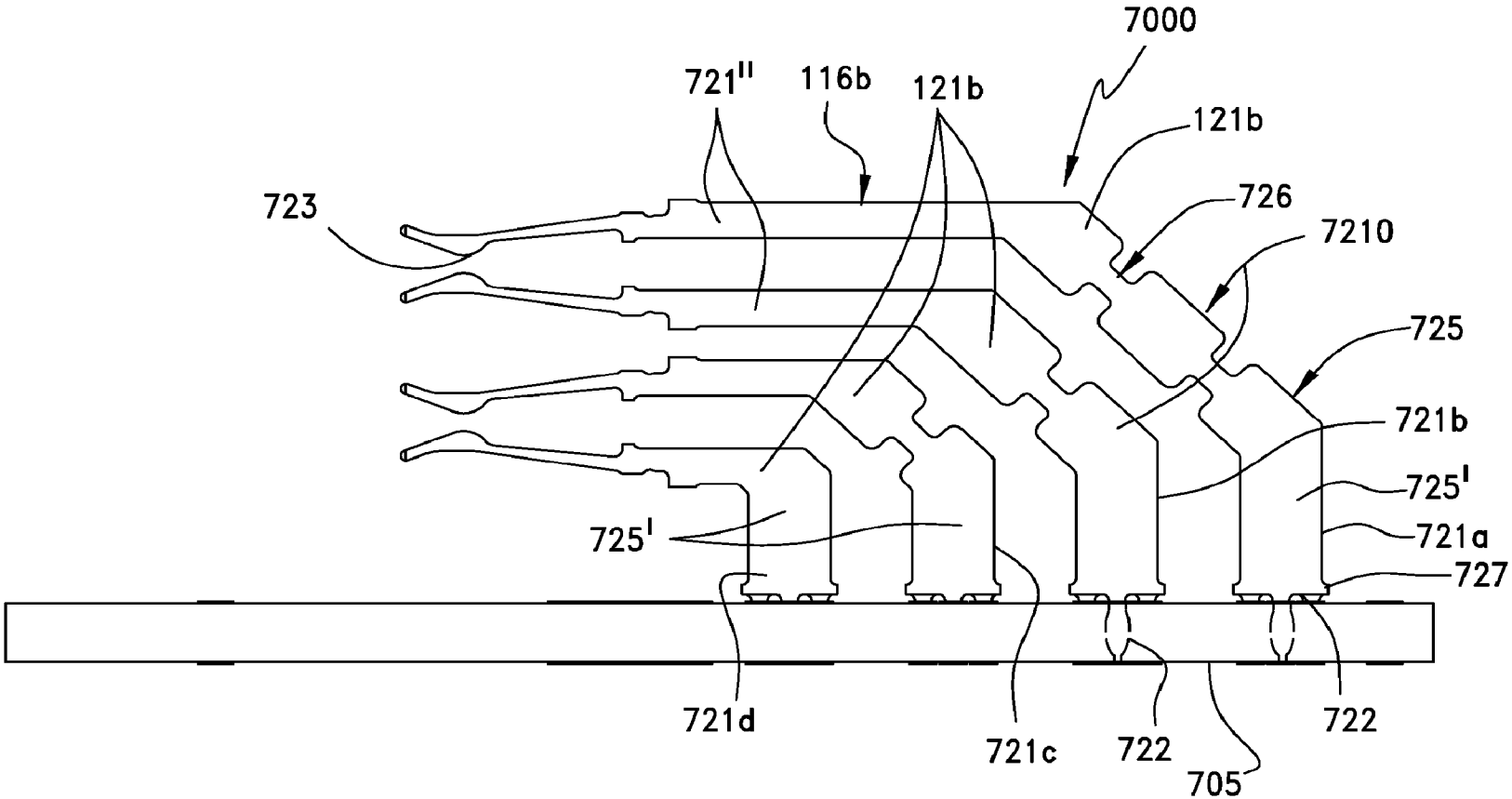
FIG. 7, is a diagrammatic view of an array of ground terminals as contained within a ground terminal wafer, and with the terminal supporting structure of the wafer removed for clarity.
Figure 8:
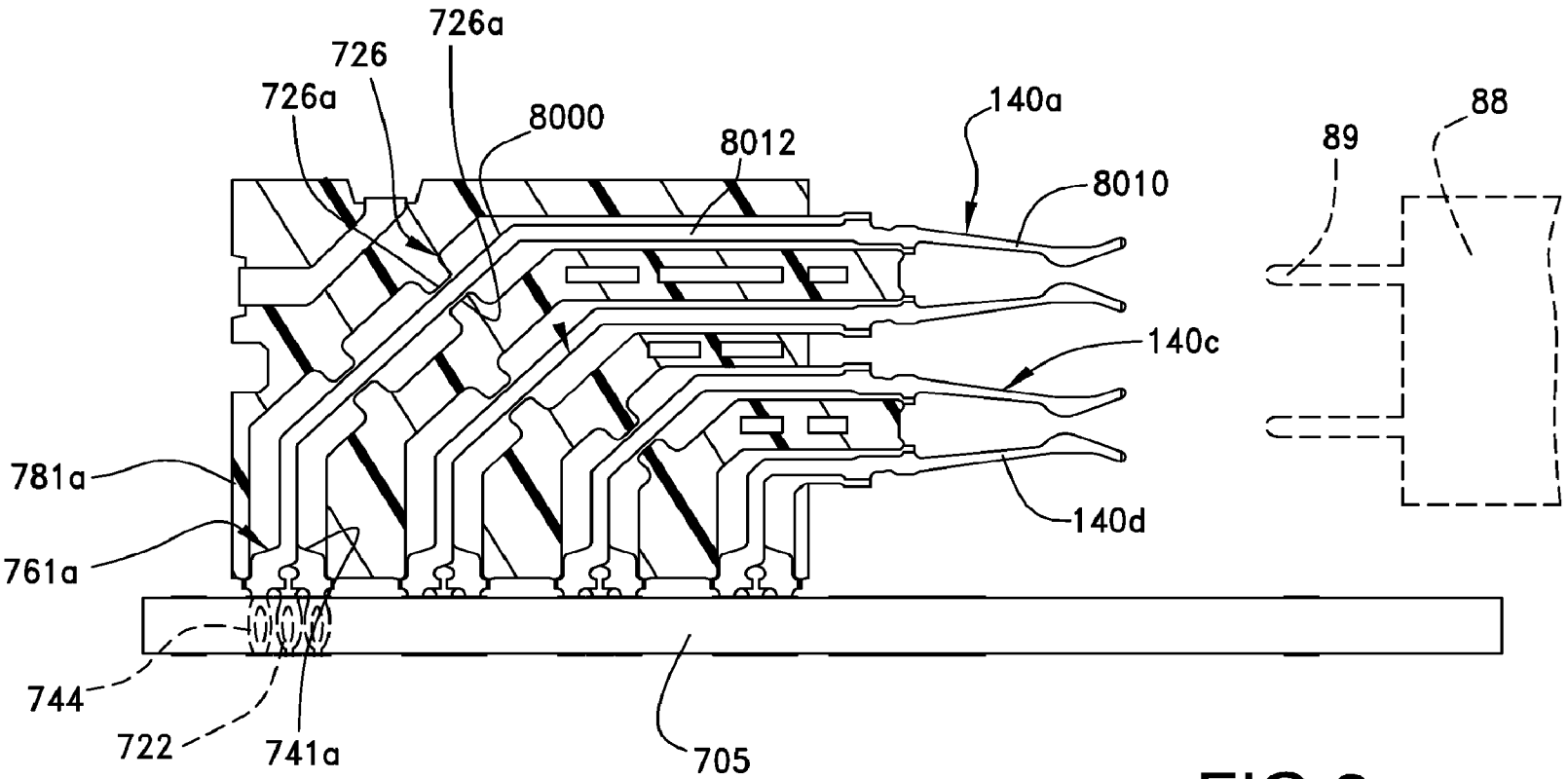
FIG. 8. is a sectional view taken through a stack of terminal assemblies of the connector of FIG. 1, showing an array of signal terminals removed from their supporting wafer in position adjacent a ground terminal wafer.

FIG. 7 illustrates a ground terminal assembly 7000 that has been removed from its supporting ground wafer 115*a*, that may be used in the connectors of the present invention in which the ground terminals 116*b* are significantly larger than their corresponding signal terminals 116*a*. This difference is size occurs primarily in the width dimension of the ground terminals and FIG. 8 illustrates the size difference between two ground and signal terminals, in which two such signal terminal assemblies 8000 are shown, but also removed from their respective supporting wafers 115*a*, 115*b*. The signal terminals 116*a* of this assembly 8000 are illustrated in broadside alignment with a set of adjacent ground terminals 116*b*. The signal terminals have contact portions 743 that will engage the opposing surfaces of edge cards 89 of an opposing, mating connector 88, tail portions 744 that fit into vias or other openings in a circuit board and body portions 8012 that connect the contact and tail portions together.

Four ground terminals 721*a-d* are illustrated in FIG. 7, and each ground terminal can be seen to have contact portions 723 at one end and tail portions 722 at opposing ends. The contact portions 723 and tail portions 722 are joined by intervening body portions 725 that extend therebetween. As shown, each of the ground terminal body portions includes a vertical component 725' extending to the tail portion 722 and a horizontal component 725" extending to the contact portion 723. Three of the terminals shown further include an angled component 7210 and the remaining terminal, 721*d*, the one that is nearest to the intersection of the housing mating face and mounting face, has no such angled component.

In another embodiment, manufacturability of the connectors of the invention is further increased by the configuration of the ground terminals 116*b*. As shown best in FIGS. 7 and 8, some of the ground terminals 721*a-c* of each ground terminal wafer are provided with notches 726 that are formed in the edges of the ground terminal body portions 121*b*. These notches 726 are provided in sets of pairs of notches, with each notch 726 of each pair extending inwardly of the ground terminal from the opposing outer edges 725*a* of the terminal body portions. Preferably, the pairs of notches 726 are formed in the angled components 7210 of the terminal body portions 725, and not in either of the vertical or horizontal components 725', 725".

Figure 9:
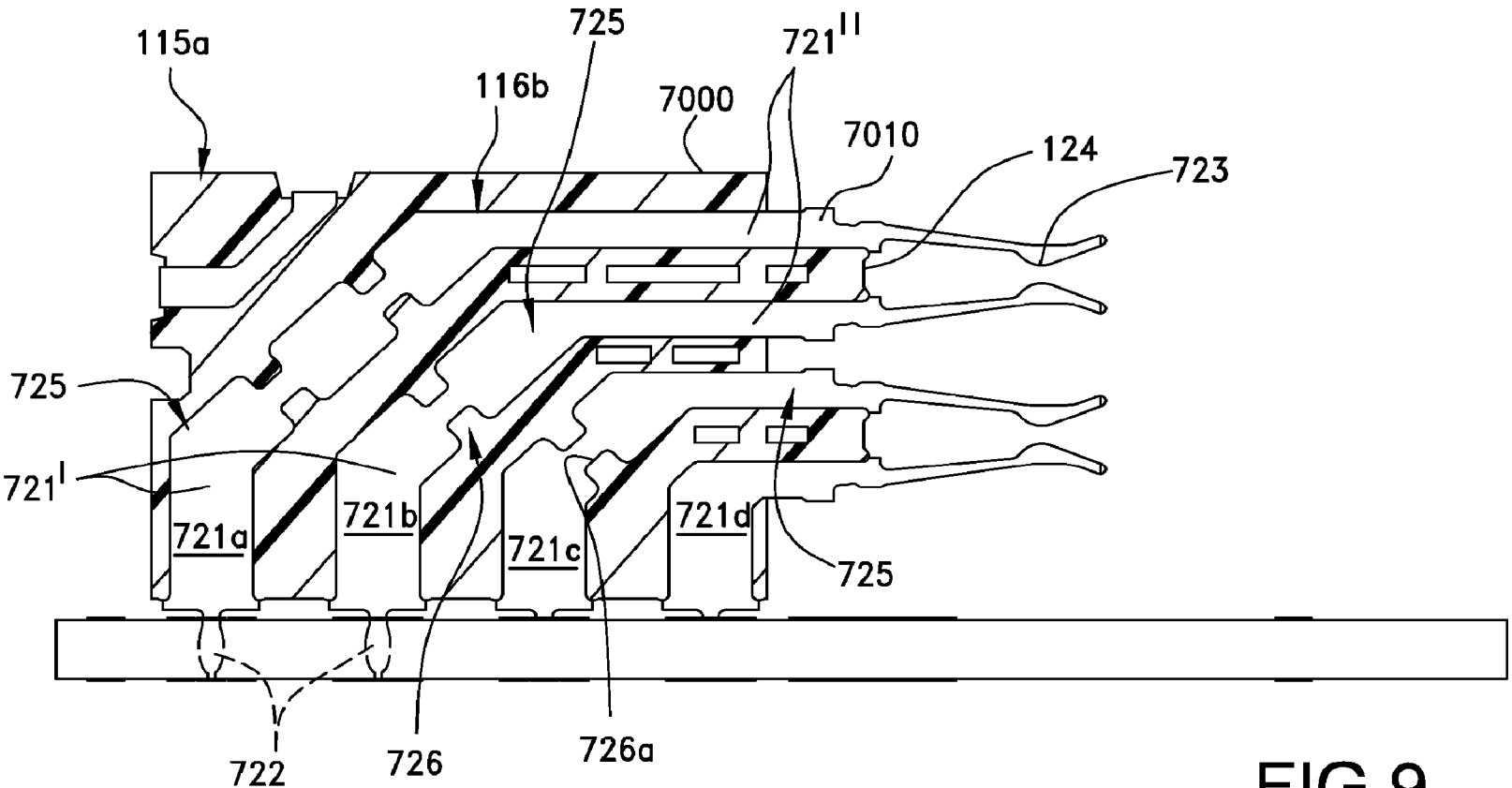
FIG. 9 is a sectional view taken through a ground terminal assembly of the connector of FIG. 1; and, FIG. 9A is an enlarged detail view of the angled body portions of the ground terminals of the assembly of FIG. 9.
Figure 9A:
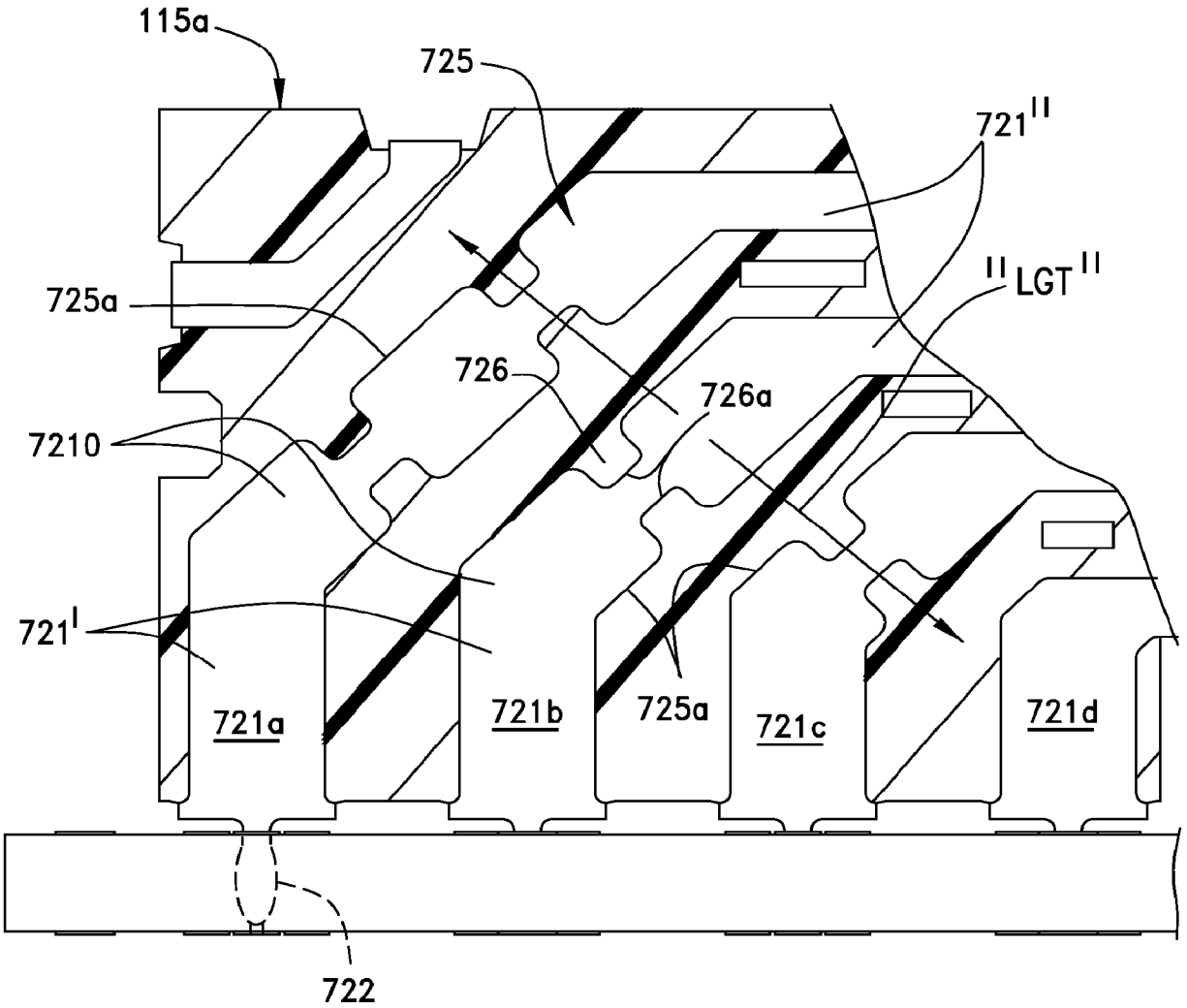

As shown in the Figures, the notches 726 of each pair of notches are aligned with each other so that their inner edges 726*a* confront each other. The notches 726 are formed in the terminal body portion angled components, where the ground terminal body portions are the widest. These notches 726 provide improved retention of the ground terminals 116*b* within each such ground terminal assembly wafer 115*a*. The notches 726 also facilitate the molding of the ground terminal assembly wafers 115*a* by providing additional, interconnected flowpaths for the molding material to traverse during the molding of the wafer 115*a* over the wide ground terminals 116*b*. In this regard, and as shown, the notches 726 of the ground terminals 116*b* are offset from any of the notches in any adjacent ground terminals. As shown in FIG. 9A, the topmost pairs of notch 726 which are disposed in the first (topmost) ground terminal 721*a* is aligned with only the pair of notches 726 in the notches in the third ground terminal 721*c* (i.e., one removed from the first ground terminal 721*a*). This alignment may occur along the line "LGT" of FIG. 9A. This line may be considered to bisect the inner edges 726*a* of each pair of notches 726 and it preferably extends perpendicular to these inner edges 726*a*. This type of alignment is preferred because the notches provide areas of strength where the molding material from which the ground terminal wafer is made extend from one side of the wafer to the other through the plane of the ground terminal body portion notches.

As shown in FIG. 8, three 721*a-c* of the four ground terminals 116*b* of each ground terminal assembly wafer 115*b* has at least one pair of notches 726, but the lowermost ground terminal 721*d*, which has no significant body portion angled component 7210 has no of notches. This lowermost (fourth) ground terminal 721*d* is the terminal that is nearest the intersection of the housing mating and mounting faces.

The ground terminals as shown in FIG. 8 also have a narrow horizontal length where the ground terminals are reduced in their width, but still are wider than either of the two signal terminals adjacent one side of the ground terminal. This reduces the overall height of the terminal assembly, while the reduced horizontal length reduces the crosstalk over the length of the terminals as they approach the contact portions the ground terminals are wider than their corresponding and adjacent signal terminals.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

What is claimed is:

1. A connector, comprising:

a housing having a mating face and a mounting face, and a plurality of wafers disposed within the housing;

a plurality of ground and signal conductive terminals being supported by the wafers, each of the terminals including a contact portion disposed at one end, a tail portions disposed at an opposite end thereof and a body portion interconnecting the contact and tail portions together, each of the wafers defining a frame that supports a respective set of terminals;

a first of the wafers supporting a plurality of ground terminals and at least a second of the wafers supporting a plurality of first signal terminals and a third of the wafers supporting a plurality of second signal terminals, the first and second signal terminals being of same size and the ground terminals being larger than the first and second signal terminals, the first and second wafers being disposed adjacent each other such that the first and second terminals face each other and are broadside coupled together so as to carry differential signals thereacross;

the first wafer being disposed adjacent the second wafer, the ground terminal body portions being wider than either of the first and second signal terminal body portions, some of the ground terminal body portions further including pairs of notches formed in edges thereof to facilitate the over molding of the first wafer over the ground terminals.

2. The connector of claim 1, wherein the notches of each pair of the ground terminal notches extend inwardly within the ground terminal body portion from opposite edges thereof.

3. The connector of claim 1, wherein the notches of each pair of the ground terminal notches are aligned with each other.

4. The connector of claim 1, wherein any pair of ground terminal notches in one of the ground terminal are offset with respect to any pair of ground terminal notches in an adjacent ground terminal.

5. The connector of claim 1, wherein at least one each pair of ground terminal notches in a first ground terminal are aligned with one pair of ground terminal notches in a third ground terminal which is separated from the first ground terminal by an intervening second ground terminal.

6. The connector of claim 5, wherein one of the pairs of ground terminal notches in the first ground terminal and one pair of the ground terminal notches in the third ground terminal lie along a common imaginary line bisecting the notches.

7. The connector of claim 1, wherein for the first wafer, the ground terminal nearest an intersection of the housing mating and mounting faces has no notches.

8. The connector of claim 1, wherein the ground terminals are wider than the first and second signal terminals, and the ground terminal notches include inner edges disposed within the ground terminal body portions and separated by an intervening width, the intervening width being not less than a width of the first and second signal terminals.

9. The connector of claim 1, wherein the first wafer includes four ground terminals and three of the four ground terminals include pairs of notches, one of the three ground terminals including two pairs of the ground terminal notches and the second and third of the three ground terminals each includes one pair of the ground terminal notches.

10. The connector of claim 1, wherein the second and third wafers include channels disposed therein that extend widthwise through the second and third wafers, thereby creating horizontal air pockets within the wafers that separate differential signal pairs within the second and third wafers.

11. The connector of claim 1, wherein the ground terminal notches enhance the retention of the ground terminals within the first wafer.

12. An electrical connector, comprising:

a housing including a mating face and a mounting face, the mating face including a edge card-receiving slot configured to receive an edge of a circuit card from an opposing, mating connector, the mounting face configured for press fit termination to a circuit board;

pairs of signal wafers held adjacent one another in the housing, each of the signal wafers including a plurality of conductive signal terminals supported thereby, each signal terminal insert including a mating edge having two rows of contact portions of the signal terminals extending therefrom proximate to the housing mating face, the two rows directed to opposite sides of the housing edge card-receiving slot, and each the signal terminal insert further including a mounting edge having a row of tail portions of the signal terminals extending therefrom, and terminal body portions interconnecting the terminal contact and tail portions together;

a plurality of ground wafers including a plurality of conductive ground terminals supported thereby, each ground wafer further including a mating edge having a row of ground terminal contact portions extending therefrom proximate to the housing mating face and on opposite sides of the housing edge card-receiving slot, and a mounting edge having a row of ground terminal tail portions extending therefrom, and terminal body portions interconnecting the terminal contact and tail portions together, one ground wafer being associated with each pair of signal wafer, each of the ground terminals being wider it its respective terminal body portions than the terminal body portions of the associated signal terminals, some of the ground terminal body portions having angled parts, and wherein, each of the ground terminal body portion angled parts includes at least one pair of notches disposed therein, the notches extending inwardly of the ground terminal body portions from opposite edges thereof.

13. The connector of claim 12, wherein for each pair of adjacent signal terminal inserts, the signal terminals are aligned with each other in a broadside fashion from the housing mating face to proximate the housing mounting face.

14. The connector of claim 13, wherein adjacent signal terminal inserts include differential signal terminal pairs.

15. The connector of claim 13, wherein the notches of each the pair of notches are aligned with each other.

16. The connector of claim 13, wherein any pair of ground terminal notches in one of the ground terminals is offset with respect to any pair of ground terminal notches in an adjacent ground terminal.

17. The connector of claim 13, further including at least first, second and third ground terminals, and wherein at least one pair of ground terminal notches in the first ground terminal is aligned with a pair of ground terminal notches in the third ground terminal.

18. The connector of claim 13, wherein for each ground terminal wafer, the ground terminal nearest an intersection of the housing mating and mounting faces has no ground terminal notches.

19. A connector, comprising:

a housing having a mating face and a mounting face, and a plurality of wafers disposed within the housing;

a plurality of ground and signal conductive terminals being supported by the wafers, each of the terminals including a contact portion disposed at one end, a tail portions disposed at an opposite end thereof and a body portion interconnecting the contact and tail portions together, each of the wafers defining a frame that supports a respective set of terminals;

a first set of the wafers supporting a plurality of the ground terminals and a second set of the wafers supporting a plurality of the signal terminals, the ground terminal body portions being larger than the signal terminal body portions, at least one of the ground terminal body portions further including a pairs of notches formed in opposing edges thereof to facilitate the over molding of the first wafer over the ground terminals, the pair of notches extending inwardly of the ground terminal body portions.

* * * * *